US005448954A

United States Patent [19]

Joubert

[11] Patent Number: 5,448,954

[45] Date of Patent: Sep. 12, 1995

[54] DISCHARGE HOPPER

[75] Inventor: Robert M. Joubert, Transvaal Province, South Africa

[73] Assignee: Rotaque (Proprietary) Limited, Potchefstroom Transvaal Province, South Africa

[21] Appl. No.: 153,245

[22] Filed: Nov. 16, 1993

[30] Foreign Application Priority Data

Nov. 16, 1992 [ZA] South Africa ..... 92/8830
May 25, 1993 [ZA] South Africa ..... 93/3649

[51] Int. Cl.[6] ..... B65G 67/24

[52] U.S. Cl. ..... 105/241.2; 105/250; 105/280

[58] Field of Search ..... 105/239, 241.2, 254, 105/280, 283, 247, 248, 250, 253, 284, 286, 311.1; 298/10; 414/378, 386, 387; 222/556

[56] References Cited

U.S. PATENT DOCUMENTS

| | | | |
|---|---|---|---|
| 719,868 | 2/1903 | Randel . | |
| 816,070 | 3/1906 | Brown . | |
| 1,105,948 | 8/1914 | Wright . | |
| 1,594,863 | 8/1926 | Warner . | |
| 1,825,943 | 10/1931 | Evans . | |
| 1,843,885 | 2/1932 | Radzievich . | |
| 2,081,999 | 6/1937 | Hallquist et al. . | |
| 3,790,008 | 2/1974 | Joubert . | |
| 4,062,460 | 12/1977 | Adler | 105/241.2 |
| 4,337,707 | 7/1982 | Brouwer . | |
| 4,353,312 | 10/1982 | Brouwer | 105/241.2 |
| 4,361,096 | 11/1982 | Funk . | |
| 4,453,871 | 6/1984 | Lonnroth | 105/241.2 |
| 4,550,665 | 11/1985 | Brouwer . | |
| 4,633,785 | 1/1987 | Du Plessis . | |
| 4,669,392 | 6/1987 | Du Plessis . | |
| 4,740,130 | 4/1988 | Prins | 105/241.2 |

FOREIGN PATENT DOCUMENTS

| | | |
|---|---|---|
| 32 24 306 | 1/1984 | Germany . |
| 72/8191 | 10/1972 | South Africa . |
| 76/2659 | 5/1976 | South Africa . |
| 76/4861 | 8/1976 | South Africa . |
| 76/5198 | 8/1976 | South Africa . |
| 76/7213 | 11/1976 | South Africa . |
| 76/7651 | 12/1976 | South Africa . |
| 77/2681 | 4/1977 | South Africa . |
| 78/1419 | 2/1978 | South Africa . |
| 78/4068 | 7/1978 | South Africa . |
| 80/0106 | 1/1980 | South Africa . |
| 80/0107 | 1/1980 | South Africa . |
| 81/6882 | 10/1981 | South Africa . |
| 84/2540 | 4/1984 | South Africa . |
| 84/9300 | 11/1984 | South Africa . |
| 84/9366 | 11/1984 | South Africa . |
| 85/2102 | 3/1985 | South Africa . |
| 88/1618 | 3/1988 | South Africa . |
| 88/2171 | 3/1988 | South Africa . |
| 4114 | 12/1911 | United Kingdom . |

*Primary Examiner*—Mark T. Le
*Attorney, Agent, or Firm*—Kenyon & Kenyon

[57] ABSTRACT

A discharge hopper rail car (10) comprises a hopper body (14) mounted on a chassis (12) which is itself supported on flanged wheels (20). The body (14) includes a discharge opening in a lower part thereof and a door structure (16) pivotally mounted on the body (14) and displaceable between a closed condition in which the opening is closed by the door structure (16) and an opened condition to permit discharge of the contents of the body (14). The door structure (16) forms a basin for collecting both liquids and fines leaking from the opening when the door structure (16) is in its closed condition.

12 Claims, 7 Drawing Sheets

DISCHARGE HOPPER

THIS INVENTION relates to discharge hoppers, and in a preferred embodiment to bottom discharge hoppers.

The present invention provides a discharge hopper rail car comprising a hopper body mounted on a chassis which is itself supported on flanged wheels, the body including a discharge opening in a lower part thereof and a door structure pivotally mounted on the body and displaceable between a closed condition in which the opening is closed by the door structure and an opened condition to permit discharge of the contents of the body, the door structure forming a basin for collecting both liquids and fines leaking from the opening when the door structure is in its closed condition.

The hopper rail car, which is referred to as a hopper in this specification, preferably has laterally spaced side walls that are asymmetrical with respect to a longitudinal vertical plane passing centrally between the wheels, and also end walls extending between the side walls and closing the ends of the hopper.

The door structure may have a curved or largely curved closure plate defining a closure surface for closing the discharge opening, and end walls extending across the ends of the closure plate for preventing the passage of fluid or fines from the ends of the door structure.

The door structure may be mounted on the body about a pivot axis which is offset from the longitudinal vertical plane passing centrally between the wheels of the hopper to facilitate opening of the door. By a suitable location of this axis, the closure surface of the door structure can move progressively away from the discharge opening as the door pivots around the axis.

Alternatively, the closure surface may have a centre or axis of curvature which is offset relative to the pivot axis to facilitate opening of the door, such that the closure surface of the door structure can move progressively away from the discharge opening as the door is pivotally displaced around the pivot axis from its closed towards its open condition.

The door structure may have door opening means mounted on it and engageable by complementary operating means at a discharge station for moving the door from its closed to its open condition.

In one embodiment of the invention the door structure may be provided with a plurality of cam bars for successively engaging suitably located rollers mounted alongside a rail track on which the hopper is to move through a discharge station so that co-operation of the cam bars with the rollers causes the door structure to pivot about the pivot axis. In a preferred embodiment, the cam bars and rollers will be constructed and arranged so that movement of the hopper in a specific direction through a discharge station will cause the door structure to pivot to such an extent that, when the door is in its open condition, liquid and fines that have collected in the basin formed by the door structure are free to pour from the door structure as the contents of the hopper are discharged. This can ensure that material washed out of the hopper by liquids, particularly water, can be discharged from the hopper only when the contents of the hopper are discharged, so that the fines and liquids are not deposited along the rail track.

The cam bars and rollers may be located and designed so that when the hopper moves through the discharge station in a direction opposite to that in which it discharges its contents, the cam bars will strike the discharge rollers and the rollers will be pivoted by the cam bars to avoid interference with the free movement of the hopper through the discharge station in that direction.

In another embodiment of the invention, the door structure may be provided with a lug which is engageable by a displacement mechanism positioned at a discharge station.

The displacement mechanism may include a lug engaging member for releasably engaging the lug and displacement means for displacing the lug engaging member and thereby pivoting the door structure about the pivot axis, in use. The displacement means may include a pressurised fluid operated piston and cylinder assembly.

The hopper may be provided with a scraper for scraping the closure surface of the door as it moves from one condition to another.

The invention will now be described, by way of example, with reference to the accompanying diagrammatic drawings, in which.

Figure 1:
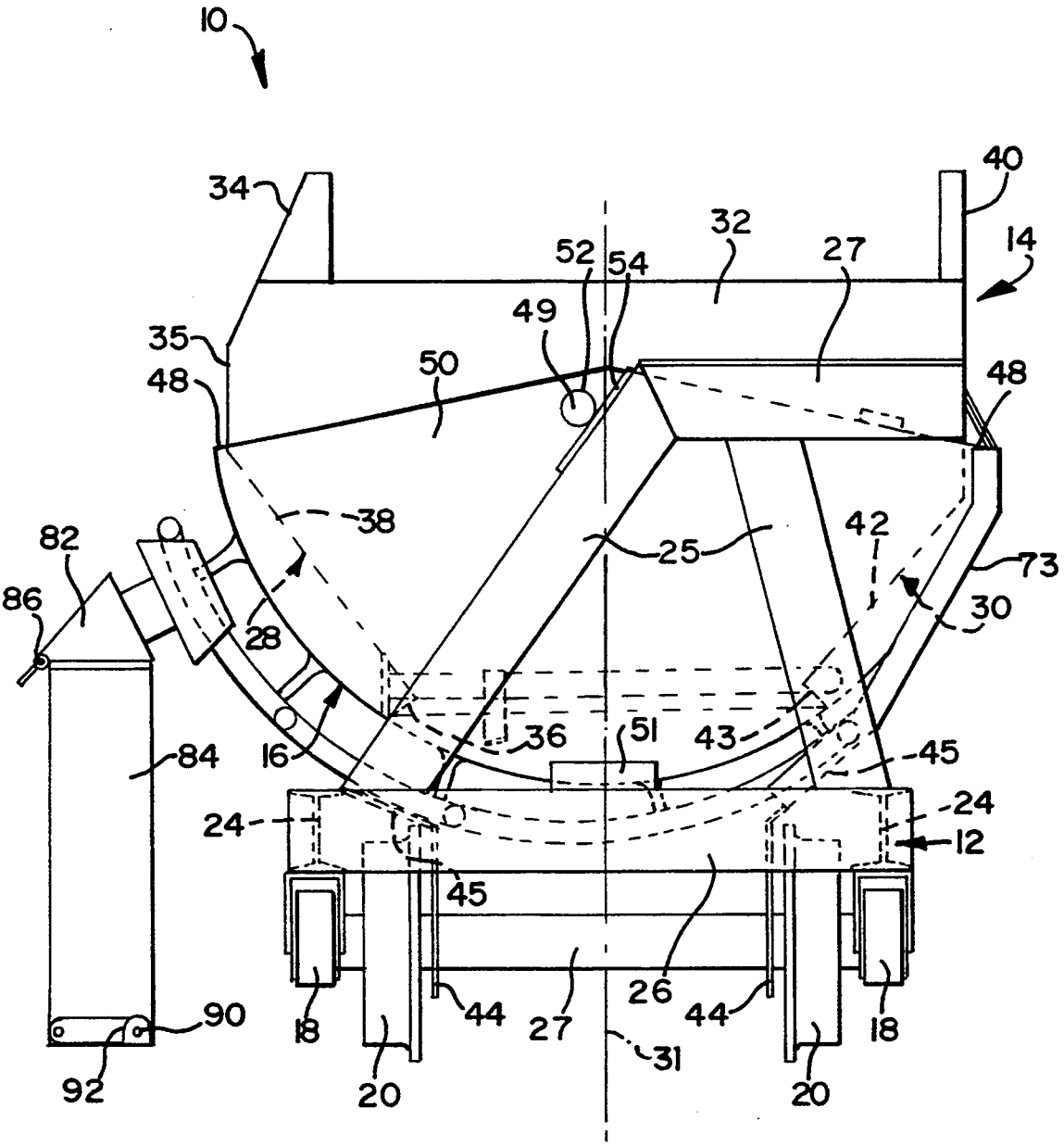
FIG. 1 is a front elevation of a bottom discharge hopper with its door structure in a closed condition, and part of a discharge station.
Figure 2:
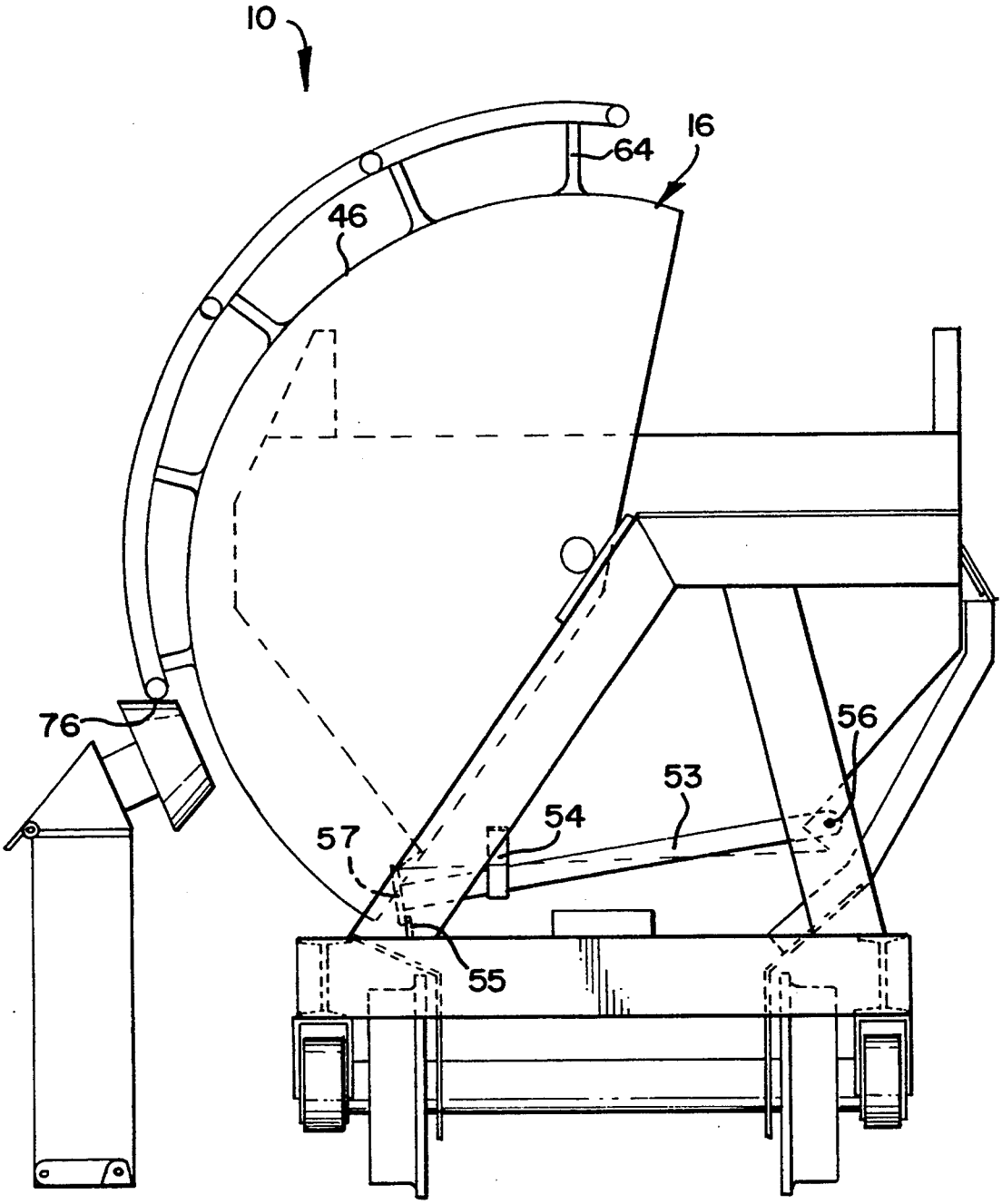
FIG. 2 shows the hopper with the door structure in its open condition.
Figure 3:
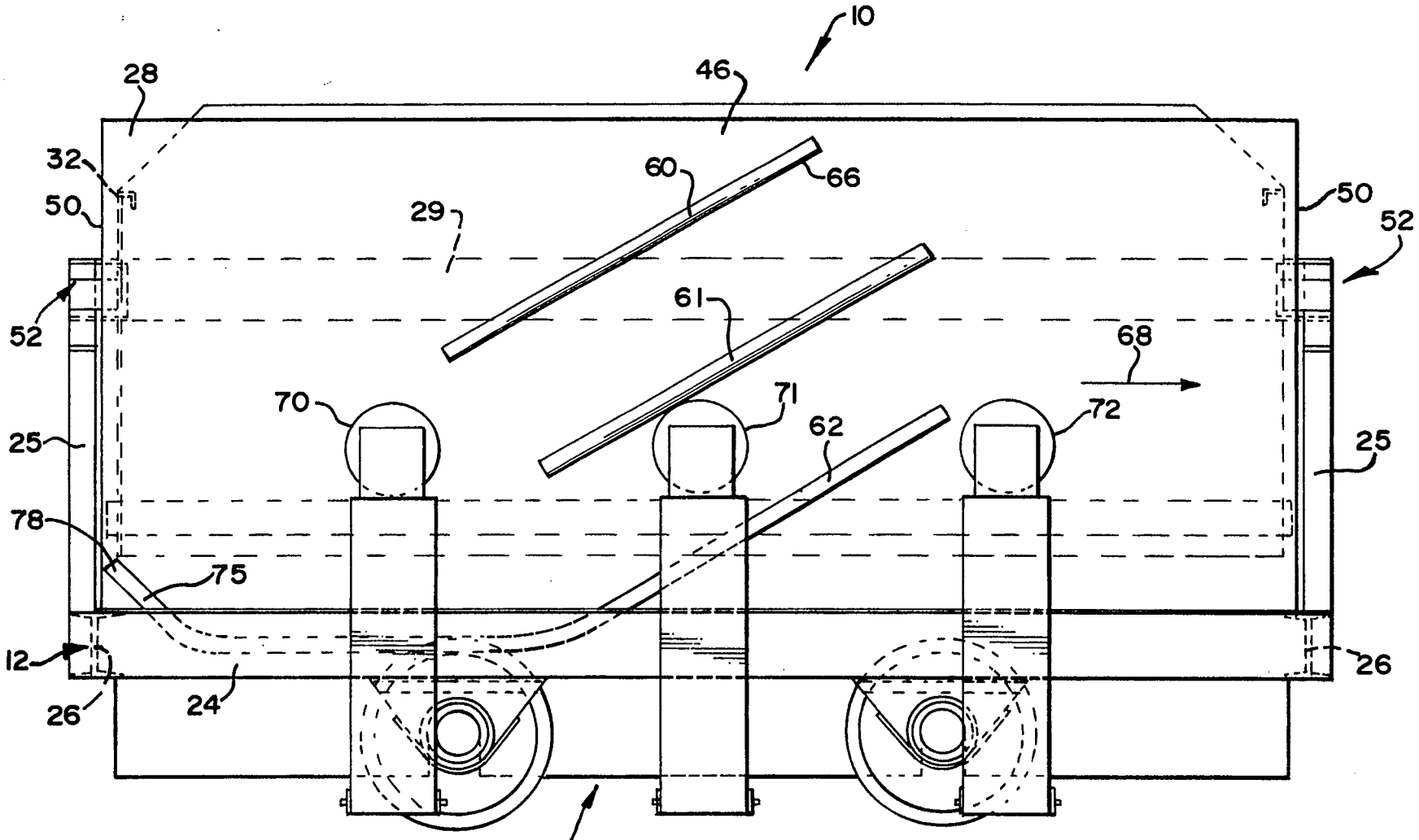
FIG. 3 is a side elevation of the partly open hopper shown in FIGS. 1 and 2 at a discharge station and partly including a discharge mechanism having operating pedestals for engaging cam bars on the door structure of the hopper.

Referring to FIGS. 1 to 5 of the drawings in more detail, a hopper rail car 10 is formed primarily from steel and comprises a chassis 12, a hopper body 14 defining a hopper cavity, and a door structure 16. The chassis is in the form of a rectangular chassis frame having longitudinally extending beams 24 and transverse end beams 26.

At each end of the hopper, an inverted substantially V-shaped structure is formed by beams 25 extending upwardly from the chassis and part of a transverse strengthening member 27. Each member 27 extends away from the upper parts of the respective beams 25, above and parallel to a respective one of the transverse beams 26. A stiffening member 29 extends between the transverse members 27 along the full length of the hopper body and serves as a reinforcing member for the hopper body.

Two wheel sets each including wheel bearings 18 are mounted in a suitable manner beneath the chassis 12. The bearings are fitted on axles 27 which are supported by flanged wheels 20 having rail-engaging surfaces laterally outwardly of their flanges. The wheels are located partly between the beams 24.

The body has laterally spaced side walls 28 and 30 that are asymmetrical about a central longitudinal plane 31, and end walls 32. The side wall 28 includes an upper outwardly inclined sloping wall section 34, a middle section 35, and a lower inwardly inclined wall section 38 extending downwardly from the middle section 35. The side wall 30 has a vertical upper wall section 40 and a lower inwardly inclined wall section 42 sloping downwardly from the upper wall section 40. The wall section 38 is sloped more steeply and is at a greater angle to the horizontal than the wall section 42.

The walls are strengthened by stiffeners, where necessary.

The lower ends of the walls have downwardly extending flanges 36 and 43 and define a discharge opening at the bottom of the hopper cavity.

Plates 44 with outwardly sloping upper parts 45 define a chute for guiding material discharged from the discharge opening.

The door structure 16 has a curved plate 46 having its upper edges 48 substantially at the level of an axis of rotation 49 of the door structure. The door has a closure surface that contacts the flanges 36 and 43 in the closed condition of the door.

The door structure has two end plates 50 which are carried pendulum-fashion by trunnions 52 mounted on brackets 54 secured to the structures 25 and to reinforced plates on the body. The trunnions permit the door structure to pivot about the axis 49.

The end plates 50 close the ends of the door structure so that the end plates 50 and the curved plate 46 define a basin-like door which closes the discharge opening. The door structure tends to move to its closed position, i.e. to the position shown in FIG. 1, under the influence of gravity.

The basin-like formation of the door structure is such that it is able to catch liquids and fines which escape through the discharge opening between the lower edges 36 and 43 of the walls and the door.

The edges 48 may be lower (or higher) than those indicated provided that the basin formed by the door structure is sufficiently deep adequately to collect water and fines that will flow from the hopper cavity in the particular mining conditions in which the hopper is to be used. In any event, suitable stops on the body can be located to engage the top of one side of the door in its closed condition to prevent it from swinging.

Blocks 51 on the end beams 26 are close to and overlap with the end plates 50 of the door and serve to restrain swinging of the door structure along the direction of axis 49.

In order to help to keep the closure surface of the door clean, a scraper bar 57 is mounted on swing arms 53 located at opposite ends of the body between the body and the door structure and pivoted on the body at 56. The scraper bar lies on the closure surface and scrapes it as the door structure opens. Because the scraper bar moves clear of the closure surface in the fully open condition, brackets 54 are provided to prevent the arms and scraper from falling when the door structure is in this condition. As shown, the scraper may have a rubber wiper blade 55 to sweep the surface.

The door structure is provided with three cam bars 60, 61 and 62 fixed to the door structure by means of brackets 64. At least the uppermost bar 60 is bolted on to the door structure by removable brackets 64 to enable it to be removed. This reduces the width of the door if it is to be put into or removed from a mine in a cage.

The cam bar 60 has a leading end 66 which, when the hopper moves into a discharge station in the direction 68 (FIG. 3) engages a first discharge roller 70 of the discharge mechanism 72. As the hopper moves through the discharge station, the discharge roller 70 rolls along the cam bar and forces the door structure to pivot about the axis 49. The cam bar 61 is located so that during this movement it will engage the roller 71 and continue to pivot the door structure even when the bar 60 has left the roller 70. The bar 62 in turn engages the roller 72 and continues to pivot the door structure. The opening forces remain in the central region of the door structure. The pivoting of the door structure thus proceeds until the door is in the position shown in FIG. 2, at which time the door is in an open condition permitting the contents of the hopper to discharge from the discharge opening. At the same time, the fines and liquids in the door structure are free to pour from the door structure into the chute defined between the plates 44.

A side plate 73 fixed to the body extends along the length of the body and guides material that may pour from the opening door structure downwardly to the chute.

As FIG. 1 shows, the axis 49 is suitably offset from the longitudinal vertical plane 31 and from the axis of curvature 74 of the plate 46 and this permits the door structure to swing in such a way that the closure surface of the closure plate 46 moves progressively further away from the flanges 36 and 43 of the walls during the opening movement of the door structure. This facilitates movement of the door and discharge of materials from the hopper and ensures that the bars 60, 61 and 62 remain accurately located on the rollers.

The rollers which are mounted to rotate about inclined axes 77 have frusto-conical shapes such that, in normal operation, the rollers provide an upper contact surface that is substantially horizontal.

The bars can be inclined in the opposite direction so that the hopper will open as it moves in the opposite direction through the station.

When the discharge roller 72 moves past the apex 76 of the cam bar 62, the door is free to move back to its closed condition and rear part 75 of the cam bar 62 serves to support the door structure in part of this movement. The door can return fully to its closed condition once it has passed the trailing end 78 of the cam bar 62.

In contrast, if the hopper moves in the opposite direction through the discharge station, or if its direction is reversed during opening, one or more of the cam bars will strike the rollers and tend to lift them. In order to prevent damage to the discharge rollers and cam bars, the discharge rollers are mounted on brackets 82 which are pivotally connected to pedestals 84 by pivots 86. This permits the discharge rollers to be moved to positions in which they permit the cam bars to move freely past the discharge structure 87.

Figure 5:
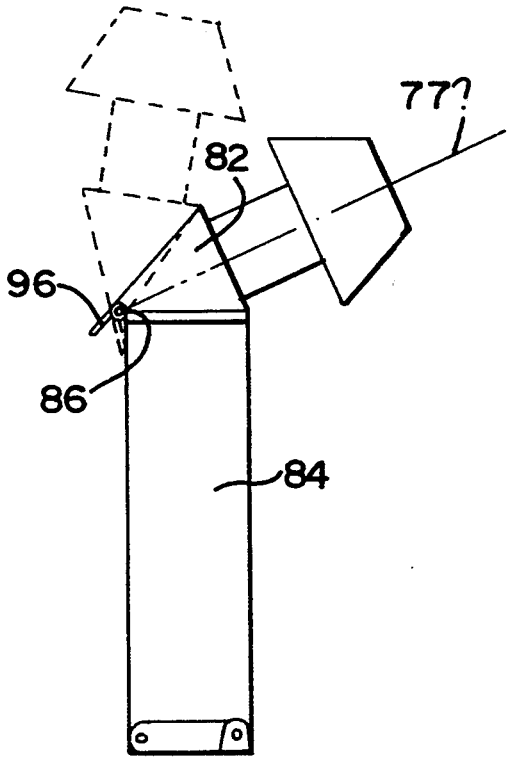

A stop 96 on each bracket 82 strikes against the respective pedestal when the bracket 82 reaches its fully raised position shown in chain lines in FIG. 5 and the discharge roller will fall back to its normal position shown in solid lines when the cam bar has moved past the discharge roller.

Figure 4:
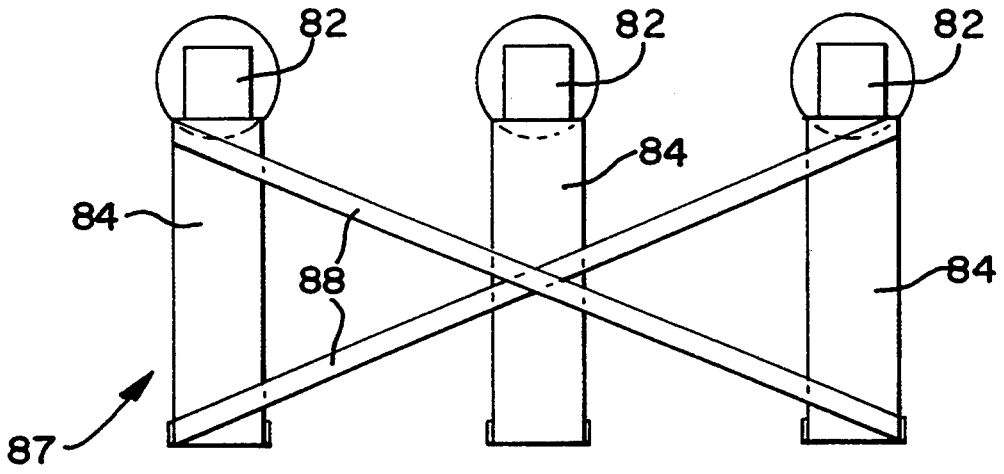
FIGS. 4 and 5 are, respectively, back and side elevations of the discharge mechanism partly shown in FIG. 3.

In order to provide a rigid discharge structure, the pedestals are connected by rigid braces 88 shown in FIG. 4. The pedestals are all pivotally mounted on a base and can be locked in place by pins 90 passing through holes in brackets 92 fixed to the base and through holes in the pedestals.

Figure 6:
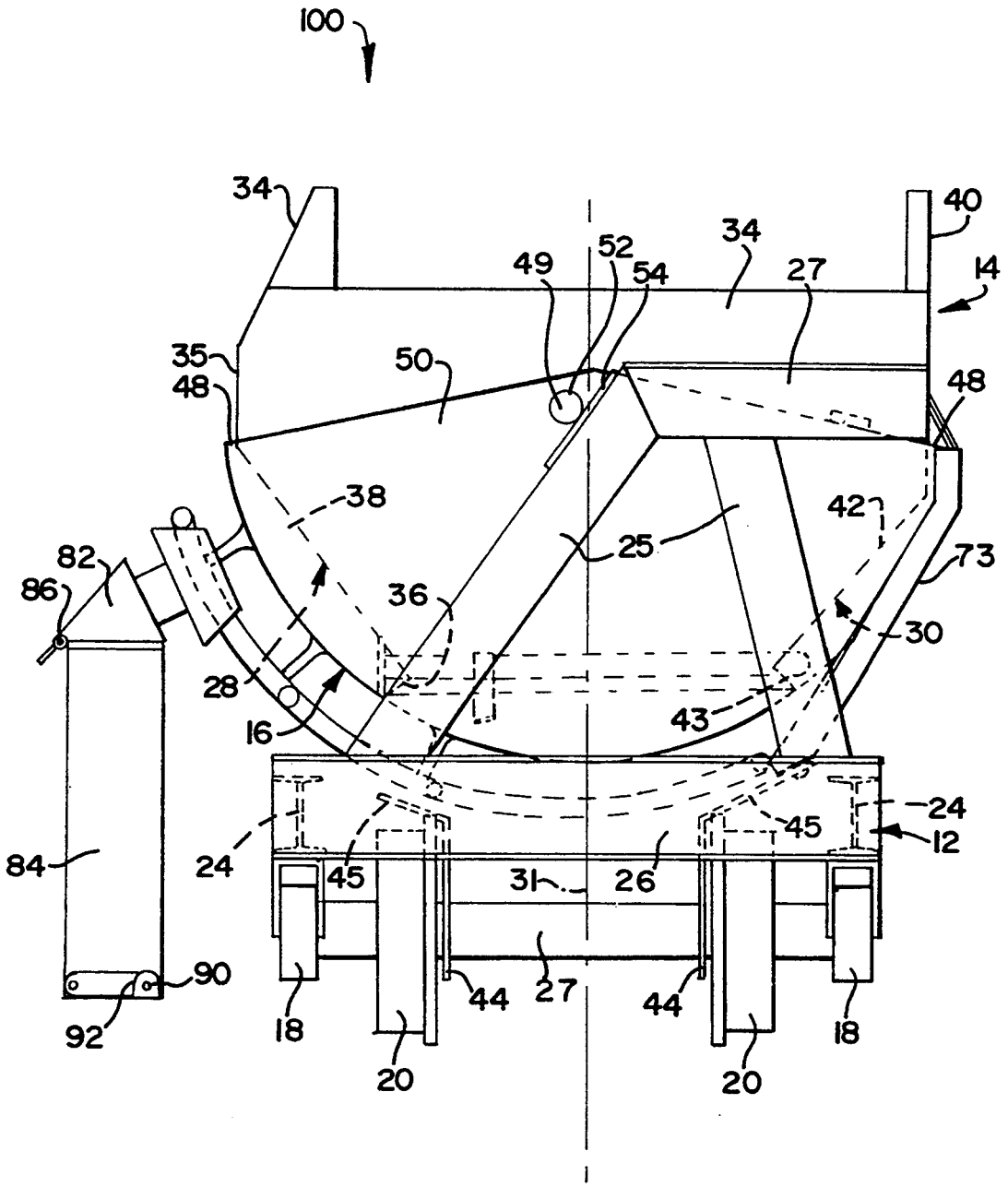
FIG. 6 shows a front view similar to FIG. 1 of another discharge hopper.

Reference is now made to FIG. 6 of the drawings, in which reference numeral 100 refers generally to another hopper rail car in accordance with the invention and, unless otherwise indicated, the same reference numerals used above are used to designate similar parts.

The hopper rail car 100 is substantially identical to the hopper rail car 10 except that in the hopper rail car 100 the beams 26 have a greater height than the beams 24. This arrangement ensures that the lower edge of the door structure 16 is positioned below the upper edges of the beams 26, the beams 26 hence serving to restrain swinging of the door structure along the direction of axis 49. Hence, the need for the retaining blocks 51 is obviated.

The hopper rail car 100 is used in substantially the identical fashion to the hopper rail car 10 described above.

Figure 7:
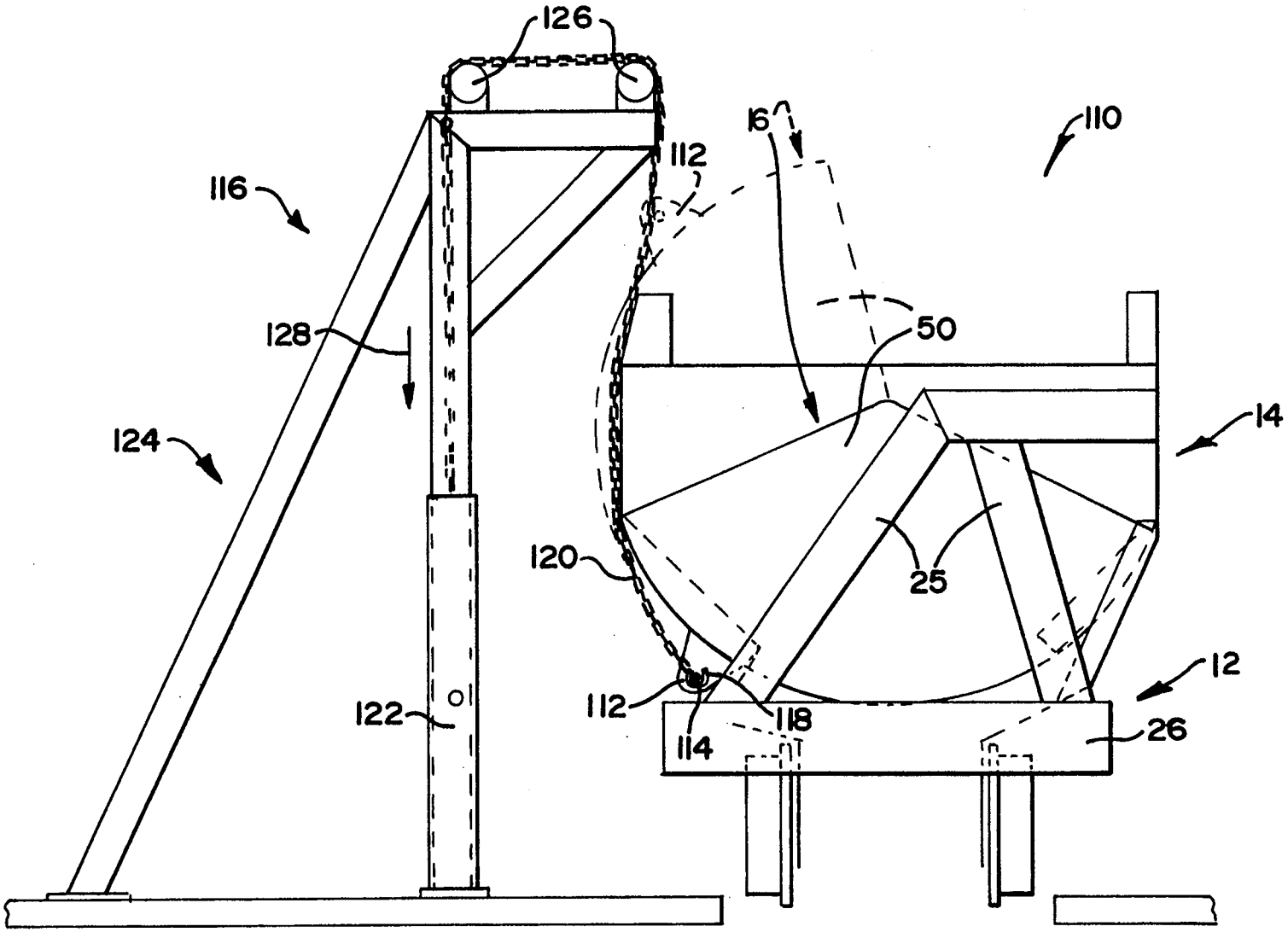
FIG. 7 shows a front elevation of yet another bottom discharge hopper with its door structure in a closed condition, and part of another discharge station.

Reference is now made to FIG. 7 of the drawings, in which reference numeral 110 refers generally to yet another hopper rail car in accordance with the invention and, unless otherwise indicated, the same reference numerals used above are used to designate similar parts.

The hopper rail car 110 is substantially identical to the hopper rail car 100 except that instead of the cam bars a lug 112 is provided on the door structure 16. A rod 114 protrudes in a longitudinal direction from the lug 112.

Displacement of the door structure 16 from its closed position (shown in solid lines) to its open position (shown in broken lines) is effected by means of a displacement mechanism, generally indicated by reference numeral 116 positioned in a discharge station. The displacement mechanism 116 includes a lug engaging member in the form of a hook 118 for releasably engaging the rod 114. The hook 118 is connected to one end of an elongate flexible member, e.g. a chain 120, the other end of which is connected to a pressurised fluid operated piston and cylinder assembly 122. The displacement mechanism 116 includes a support structure 124 which supports a pair of pulleys 126 at an elevated position. The chain 120 extends around the pulleys 126.

In use, the hopper rail car 110 is positioned in a discharge station and the hook 118 is connected to the rod 114. The pressurised fluid operated piston and cylinder assembly 122 is activated so as to displace the chain 120 in the direction of arrow 128 thereby to displace the door structure 16 to its open condition. When the contents of the hopper rail car 110 have been discharged, the piston and cylinder assembly 122 is operated so as to permit the door structure 16 to return to its closed condition and the hook 118 is disconnected from the rod 114 permitting the hopper rail car 110 to be displaced from the discharge station.

Figure 8:
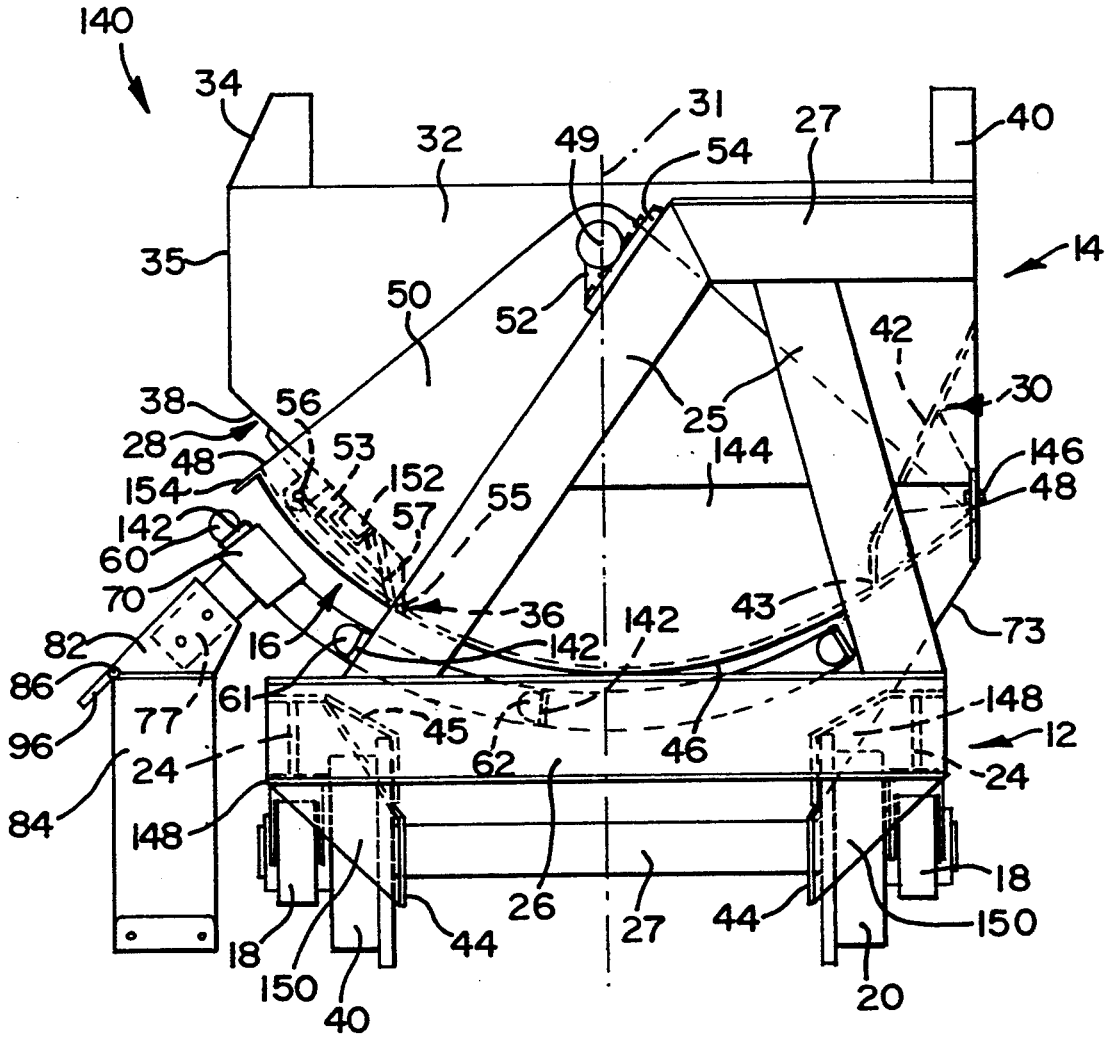
FIG. 8 shows a front view similar to FIGS. 1 and 6 of still another bottom discharge hopper in accordance with the invention.

Reference is now made to FIG. 8 of the drawings, in which reference numeral 140 refers generally to another hopper rail car in accordance with the invention. The hopper rail car 140 is similar to the hopper rail car 10 and, unless otherwise indicated, the same reference numerals used above are used to designate similar parts.

One difference between the hopper rail car 140 and the hopper rail car 10 is that in the hopper rail car 140, the axis 49 is coincident with the central longitudinal plane 31. However, as is the case with the hopper rail car 10, the axis of curvature of the plate 46 of the hopper rail car 140 is offset relative to the axis 49 so that the closure surface of the closure plate 46 moves progressively further away from the flanges 36 and 43 of the walls during the opening movement of the door structure. The scraper is mounted at 56, which in this case is on the same side as the scraper.

In addition, plates 142 are attached to the cam bars 60, 61 and 62 so that in use, there is line contact between the discharge rollers 70, 71, 72 and the plates 142. This permits the use of circular cylindrical rollers. The contact surfaces of the plates 142, i.e. the surfaces against which the discharge rollers 70, 71, 72 abut, are radially aligned with the axis 49 so that the lines of contact between the plates and the rollers each is in a radius of the axis 49. The line contact between the rollers and the plates 142 is preferable to the point contact between the rollers and the cam bars 60, 61, 62 as in the hopper rail car 10. The line contact between the plates 142 and the rollers 70, 71, 72 promotes rotation and smooth operation of the rollers and hence displacement of the door structure to its open condition.

Other differences between the hopper rail car 140 and the hopper rail car 10 include the provision of a spillage plate 144 at each end of the chassis 12. Each spillage plate 144 is positioned inwardly of and secured to the beams 25, the plates 144 serving the dual function of restraining swinging of the door structure along the direction of axis 49 and as guide plates to guide material discharged from the hopper body 14 when the door structure 16 is displaced to its open condition.

In the embodiment shown in FIG. 8 of the drawings, the side plate 73 is connected to the associated plate 44 and they are bolted to the body by a plurality of nut and bolt assemblies 146. In addition, mud guards 148 and skirt plate stiffeners 150 had been added to provide support to the plates 44. Further, a stiffener 152 has been added to the wall section 38 and the plate 46 has been flanged at 154 for extra strength.

It is to be appreciated, that additional or other strengthening may be added depending on the particular application for which the hopper is intended.

The hopper rail car 140 is used in substantially the identical fashion to the hopper rail car 10 described above.

A hopper constructed in accordance with the invention has the significant advantage that it can collect liquids and fines that are emptied into the hopper and which will normally run out of a conventional hopper during movement of the hopper along a rail track. As these fines often contain heavier and valuable materials, these losses are reduced.

I claim:

1. A discharge hopper rail car comprising a hopper body mounted on a chassis which is itself supported on flanged wheels, the body including a discharge opening in a lower part thereof, and a door structure pivotally mounted on the body and displaceable between a closed condition in which the opening is closed by the door structure and an opened condition to permit discharge of the contents of the body, the door structure having an upper edge, the lowermost portion of which, in the closed condition of the door, is positioned substantially above the level of the discharge opening so that in its closed condition the door structure forms a basin for collecting both liquids and fines leaking from the opening when the door structure is in its closed condition.

2. A discharge hopper rail car according to claim 1, in which its door structure has a curved closure plate defining a closure surface for closing the discharge opening, and end walls extending across ends of the closure plate for preventing the passage of fluid or fines from the ends of the door structure.

3. A discharge hopper rail car according to claim 2, having laterally spaced side walls that are asymmetrical with respect to a longitudinal vertical plane passing centrally between the wheels, and also end walls extending between the side walls and closing the ends of the hopper.

4. A discharge hopper rail car according to claim 3, in which the door structure is mounted on the body to move about a pivot axis which is offset from the longitudinal vertical plane passing centrally between the wheels of the hopper to facilitate opening of the door, so that the closure surface of the door structure can move progressively away from the discharge opening as the door pivots towards its opened condition.

5. A discharge hopper rail car according to claim 2, in which the door structure is mounted on the body to move about a pivot axis, the closure plate of the door structure having an axis of curvature which is offset from the pivot axis to facilitate opening of the door, so that the closure surface of the door structure can move progressively away from the discharge opening as the door pivots towards its opened condition.

6. A discharge hopper rail car according to claim 4, in which its door structure has door opening means mounted on it for engaging complementary operating means at a discharge station for moving the door, in use, from its closed to its open condition.

7. A discharge hopper rail car according to claim 6, wherein the door opening means comprises a plurality of cam bars for successively engaging suitably located rollers mounted alongside a rail track on which the hopper is to move through a discharge station so that cooperation of the cam bars with the rollers causes the door structure to pivot about the pivot axis.

8. A discharge hopper rail car according to claim 2, which includes a scraper for scraping the closure surface of the door as it moves from one condition to another.

9. A discharge hopper rail car according to claim 2, in which the door structure is mounted on the body to move about a pivot axis, the closure plate having upper edges which in the closed condition of the door structure are substantially at the level of the pivot axis.

10. A discharge hopper rail car according to claim 8, in which the scraper is mounted on the hopper body for displacement relative thereto in order that it remains in contact with the closure surface as the door structure moves between its opened and closed conditions.

11. A discharge hopper rail car according to claim 1, in which its door structure has a largely curved closure plate defining a closure surface for closing the discharge opening, and end walls extending across ends of the closure plate for preventing the passage of fluid or fines from the ends of the door structure.

12. A discharge hopper rail car according to claim 11, in which the door structure is mounted on the body to move about a pivot axis, the closure plate having upper edges which in the closed condition of the door structure are substantially at the level of the pivot axis.

* * * * *